United States Patent [19]

Frantzen et al.

[11] 3,971,682

[45] July 27, 1976

[54] ETCHING PROCESS FOR ACCURATELY MAKING SMALL HOLES IN THICK MATERIALS

[75] Inventors: John J. Frantzen, North St. Paul; Lee C. Barton, St. Anthony Village, both of Minn.

[73] Assignee: Buckbee-Mears Company, St. Paul, Minn.

[22] Filed: July 11, 1974

[21] Appl. No.: 487,665

[52] U.S. Cl. ..... 156/11; 156/16; 156/345

[51] Int. Cl.[2] ..... C23F 1/02

[58] Field of Search ..... 96/36.1; 156/7–16, 156/18, 345

[56] References Cited

UNITED STATES PATENTS

| | | | |
|---|---|---|---|
| 2,536,383 | 1/1951 | Mears et al. | 156/11 X |
| 2,750,524 | 6/1956 | Braham | 156/11 X |
| 3,415,699 | 12/1968 | Brown | 156/11 X |
| 3,679,500 | 7/1972 | Kubo et al. | 156/11 |

*Primary Examiner*—William A. Powell

*Attorney, Agent, or Firm*—Jacobson & Johnson

[57] ABSTRACT

A sheet of metallic material having a thickness T is covered on one side by an etchant resist and on the opposite side by an etchant resist and a removable shield. Etching is first performed on the side with only the etchant resist layer. Next, the shield is removed and the material is etched from both sides to produce an opening having a minimum dimension less than the thickness T of the material.

1 Claim, 3 Drawing Figures

ETCHING PROCESS FOR ACCURATELY MAKING SMALL HOLES IN THICK MATERIALS

BACKGROUND OF THE INVENTION

1. Field of the Invention

This invention relates generally to making small openings or slots in shadow masks for color television tubes as well as other articles, more specifically, this is an etching process for producing accurate holes or openings in a continuous sheet of material in which the openings have a dimension smaller than the thickness of the material.

2. Description of the Prior Art

In a colored television picture tube, a shadow mask or aperture mask is located between the electron guns at the rear of the tube and the phosphor coated face plate at the face of the tube. Electron beams pass through tiny openings or apertures in the shadow mask and impinge upon a suitable color producing phosphor dot on the face plate. Located in line with the openings of the shadow mask are three phosphor dots, a triad, one dot for each of the three primary colors. During operation of the picture tube the shadow mask openings are used as a guide for the electron beams. Thus, one of the uses of the present invention is in a shadow mask for a television tube. Another application of the present process is in the manufacture of small slits or guides for use in reticles or the like in which slight openings or apertures are required to have the minimum dimension less than the thickness of the material.

The problem in making small holes or apertures in thicker material is that it is impossible to accurately etch an opening which has a minimum dimension less than the thickness of the material. That is, the conventional etching from both sides produces over-etching as well as irregular etching. The over-etching is produced by the lateral etching of the material that inherently accompanies etching perpendicular to the surface of a material. Consequently, the process of accurately making holes having a minimum dimension less than the thickness of the material is a difficult task. The task is even more difficult when applied to a continuous production of etched material. Thus, the present invention comprises a process for continuously and accurately etching openings which have a minimum dimension less than the thickness of the material being etched. More specifically, the present invention comprises a process of continuously forming accurate holes which have a minimum dimension that is on the order of 40% of the thickness of the metal.

At the heart of the present invention is a reusable etchant resistant shield that covers the layer of etchant resist and one side of the web material during the initial phase of the etching process. During a later phase of the etching process the reusable shield is removed and the web material is etched from both sides.

SUMMARY

Briefly, the present invention comprises a process where openings having a dimension less than the thickness of the material are uniformly, accurately and continuously etched by a multiple step process of etching. The material in sheet form is partially etched from one side and is completely protected from etching on the opposite side by a protective shield which covers both the resist and the exposed portion of the material which are located on the opposite side of the material. In the next step, the removable shield is stripped off and etching continues from both sides until the final dimensioned article is obtained.

DESCRIPTION OF THE PREFERRED EMBODIMENT

Figure 1:
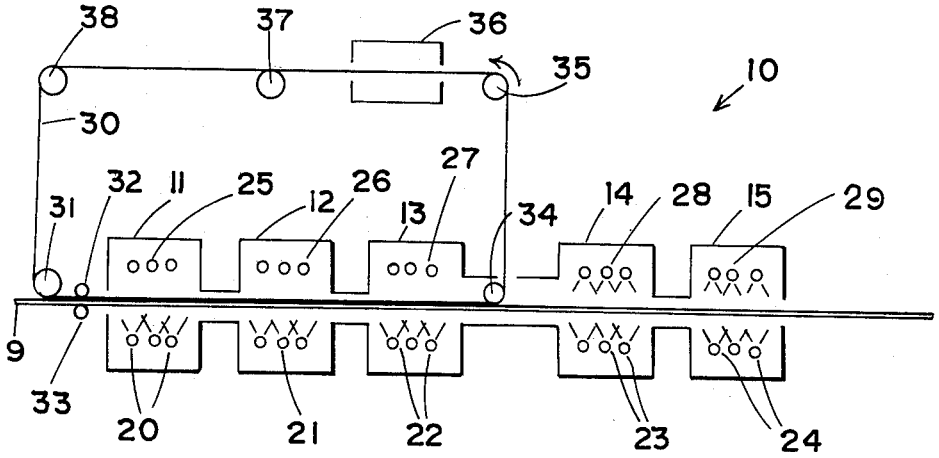
FIG. 1 shows in schematic form a system having a set of etchers and a continuous reusable belt shield for protecting one side of the article from etching.

Referring to FIG. 1, reference numeral 10 generally designates system 10 for continuously processing and etching elongated sheets of material to produce fine accurately aligned holes in the material. System 10 includes a plurality of etch stations 11, 12, 13, 14 and 15 in which etchant spray can be supplied through a lower set of spray nozzles 20, 21, 22, 23 and 24 or an upper set of nozzles 25, 26, 27, 28 and 29. In the embodiment shown the upper set of nozzles 25, 26 and 27 are not used as it is desired to etch only from beneath in these units. Reference numeral 9 designates a continuous sheet of material which is to be etched so that it has a plurality of openings having a minimum dimension less than the thickness of the material being etched. The sheet of material 9 passes under roller 31 between rollers 32 and 33, through etching stations 20, 21 and 22, underneath roller 34 and finally through etch stations 14 and 15. Located on top of the sheet of material 9 is a reusable shield 30 which is held in place on top of the elongated material 9 by a set of rollers 31, 32 and 33. Material 9 and reusable shield 30 simultaneously pass between rollers 32 and 33, through etching chambers 11, 12 and 13 and underneath roller 34. The reusable shield 30 is then separated from web material 9 by roller 34. Reusable shield 30 passes around roller 34, roller 35, through a cleaning unit 36 and over rollers 37, 38 and 31 where the cleaned shield re-enters etching statons 20, 21 and 22.

Figure 2:
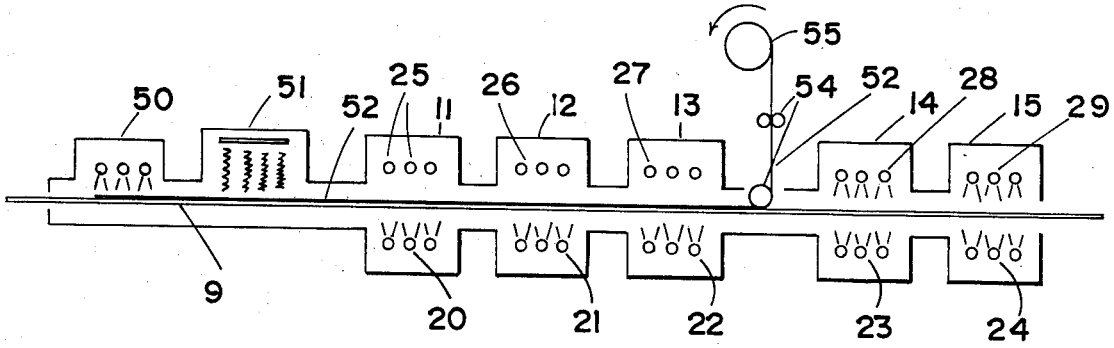
FIG. 2 shows an alternate embodiment of the invention in which a reusable shield is sprayed on, allowed to dry and then be removed by peeling off on a roller.

Referring to FIG. 2, an alternate embodiment of the invention is shown with the reference numeral of similar parts of the system being identical. The embodiment shown in FIG. 2 utilizes a reusable shield in a somewhat different manner by applying spray coating of a plastic film at station 50. The film is cooled and dried at station 51 to produce a protective shield on top of the resist layer on web material 9. The web material 9 is then processed through stations 20, 21 and 22 until it is separated by a set of take-up rollers 54. The shield can then be reprocessed and reapplied in liquid form, if desired.

Figure 3:
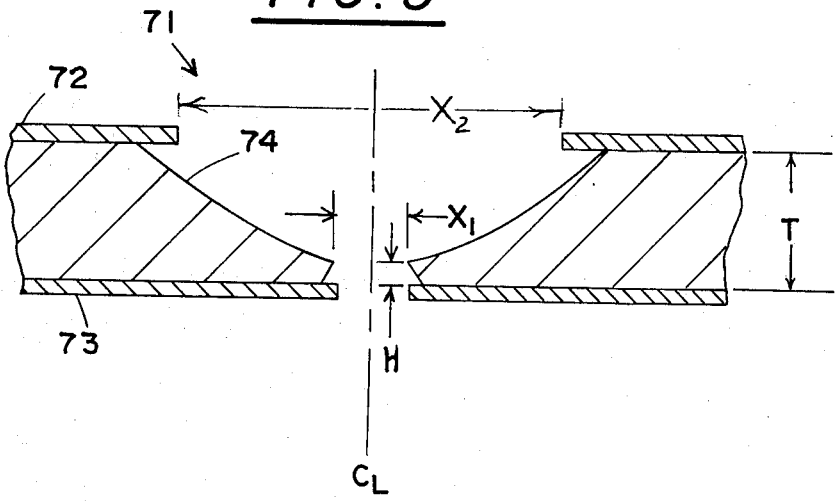
FIG. 3 shows an enlarged cross section view of the opening which is produced in a thicker material.

Referring to FIG. 3, reference is made to the drawing in which reference numeral 71 indicates a partially enlarged cross section of an opening in an article having a thickness T. The photoresist is defined by reference numerals 72 and 73. As can be seen in FIG. 3, behind resist layer 72 is a substantially larger and dished out region as compared to the portion behind resist layer 73. The overall dimension of the pattern of the photoresist 72 is designated by $X_2$ and is substantially larger than the overall dimension of the photoresist pattern located in photoresist layer 73 and designated by $X_1$. The dimension of the opening in the material is also denoted by $X_1$ and can be seen to be less than the dimension T.

Referring to FIG. 1, the operation and process will now be described in more detail. Typically, an operator may wish to continuously manufacture small holes in sheet material. A typical example is a shadow mask which has a thickness T of 0.006 of an inch and it requires opening $X_1$ of 0.002 of an inch at its minimum dimension. In order to obtain these size openings as shown in FIG. 3, a photoresist pattern is placed on both sides of web material 74. As seen in FIG. 3, top side 72 has a larger opening $X_2$ of 0.020 of a inch. During the etching process the side covered by resist 73 would be the top side and is in contact with the shield as web 9 passes through etching stations 20, 21 and 22. The purpose of using a shield on top of the resist coating 73 is to ensure that no etchant fumes or etchant spray come in contact with the surface beneath resist layer 73 as any fumes or spatterings would partially etch the surface and have an adverse effect on the quality of the mask. When web 9 is etched in etch stations 20, 21 and 22 the etchant spray is directed vertically upward through a set of spray nozzles 20, 21 and 22 to impinge etchant fluid on the area which is located behind resist 72. By directing the etchant upward to the underside of the web, the problems of run down of the etchant are greatly reduced. The etching is partially performed at three stations in order to ensure that any abnormalities or irregularities due to a particular set of nozzles are eliminated.

When the article is finished etching, as can be seen in FIG. 3, the dimension H is only on the order of 10 to 20% of the thickness T. This ensures that the etching to depth from the side with resist 73 will not produce excessive lateral etching at the opening in material 74.

The types of shields which have been found to work satisfactorily with the present process are rubber belts containing magnetized particles that cause the belt to cling to the article being etched; other suitable materials are the pressure sensitive polyester types, vinyl chloride or vinyl acetate films. The latter have the advantage of clinging to the surface of the article. Still another material which is suitable is polyethylene coated Mylar.

The features of the shield which are important are that the shield itself must be flexible enough to entirely and completely seal off the side containing the resist and yet not cling sufficiently hard to the resist so as to remove or damage the resist layer when the shield is removed.

In the preferred embodiment, the shield is reuseable, however, suitable low cost non-reuseable shields are envisioned as being suitable for use with the present invention.

We claim:

1. A process for making etched openings in a continuous sheet of material whereby the etched openings have a minimum dimension which is less than the thickness of the continuous sheet of material;

forming an etchant resist pattern on opposite sides of a continuous sheet of material having a thickness T, a first etchant resist pattern defining an opening larger than the thickness of the material and a second etchant resist pattern on the opposite side defining an opening having a dimension which is less than 40% of the thickness T of said material;

placing so as to face downward the first side of the continuous sheet of material having etchant resist defining an opening which is larger than the thickness of said material;

applying a removable etchant resist shield over said material and the first etchant resist pattern which defines an opening having a dimension which is less than 40% of the thickness T of said material to completely cover said material and said etchant resist pattern to thereby prevent etchant from attacking said material while the opposite side of said material is being etched;

first spray etching only on the first side of said material having etchant resist defining an opening which is larger than the thickness T of said material by spraying etchant from below said material until the depth of the etch on the first side of said material produces a region which has a thickness on the order of the minimum dimension of the final opening;

removing the etchant resist shield; and then simultaneously etching the material from the first and second side of said material to simultaneously remove material from said first and said second sides of said material to thereby produce an opening in said material which has a mimimum dimension which is less than 40% of the thickness T of said material.

* * * * *